US008590737B2

(12) United States Patent
Clarke et al.

(10) Patent No.: US 8,590,737 B2
(45) Date of Patent: Nov. 26, 2013

(54) DISPENSING CANISTER FOR DELIVERY OF SOLID MEDICATION

(75) Inventors: Darcy Clarke, Kent, WA (US); Kameron Bumb, Snoqualmie, WA (US); Michael Sherrod, Maple Valley, WA (US); Geoffrey Wathen, Corvallis, OR (US)

(73) Assignee: Talyst Inc., Bellevue, WA (US)

( * ) Notice: Subject to any disclaimer, the term of this patent is extended or adjusted under 35 U.S.C. 154(b) by 49 days.

(21) Appl. No.: 13/313,418

(22) Filed: Dec. 7, 2011

(65) Prior Publication Data

US 2012/0095593 A1 Apr. 19, 2012

Related U.S. Application Data

(60) Continuation-in-part of application No. 13/247,206, filed on Sep. 28, 2011, now Pat. No. 8,272,534, which is a division of application No. 12/477,281, filed on Jun. 3, 2009, now Pat. No. 8,066,150.

(51) Int. Cl.
*G07F 11/00* (2006.01)

(52) U.S. Cl.
CPC ..... *G07F 11/00* (2013.01)
USPC ..... 221/198; 221/231; 221/258; 221/277; 700/243

(58) Field of Classification Search
USPC ..... 221/197, 198, 231, 258, 277; 700/243
See application file for complete search history.

(56) References Cited

U.S. PATENT DOCUMENTS 3,319,825 A * 5/1967 Dore ..... 221/186
3,999,682 A 12/1976 Albright et al.
4,032,039 A 6/1977 Schuller
4,111,334 A 9/1978 Winn et al.
4,143,791 A 3/1979 Bienfait
4,469,217 A 9/1984 Meyer et al.
4,560,086 A 12/1985 Stol
4,589,571 A 5/1986 Sykes
4,600,119 A 7/1986 Olson
4,739,233 A 4/1988 Marcade
4,759,469 A 7/1988 Lowrance et al.
4,889,259 A 12/1989 Lowrance et al.
5,213,232 A 5/1993 Kraft et al.
5,222,634 A 6/1993 Hayes
5,542,570 A 8/1996 Nottingham et al.
5,649,641 A 7/1997 Campoli
5,667,096 A 9/1997 Wu
(Continued)

OTHER PUBLICATIONS

European Search Report, Jun. 5, 2012.

*Primary Examiner* — Mark A Deuble
(74) *Attorney, Agent, or Firm* — Alston & Bird LLP

(57) ABSTRACT

The apparatus and process of the present invention provides for the automated, singulated dispensing of articles, particularly solid oral medication in predetermined quantities. The apparatus of the invention is a canister which houses a screw having a channel of a certain width and depth that corresponds to the dimensions of a particular pill type. The screw is removably mounted within a canister, such that screws having channels of various dimensions, corresponding to a particular pill to be dispensed, can be substituted into the canister. Upon rotation of the screw, the articles to be dispensed travel along a sidewall, pass under a singulation ramp, and exit from an aperture on the proximal end of the canister. A rotational driver-coupling is mounted to the proximal end of the screw, allowing for activation of the canister by engaging the screw. The present invention further describes methods of dispensing articles.

35 Claims, 11 Drawing Sheets

(56) References Cited

U.S. PATENT DOCUMENTS

| | | | | |
|---|---|---|---|---|
| 5,884,806 | A | 3/1999 | Boyer et al. | |
| 6,145,699 | A | 11/2000 | Pollock | |
| 6,776,306 | B1 | 8/2004 | Michael et al. | |
| 7,007,820 | B1 | 3/2006 | Cumer | |
| 7,066,348 | B2 | 6/2006 | Skavnak | |
| 7,412,302 | B2 | 8/2008 | Cobb et al. | |
| 7,853,355 | B1 | 12/2010 | Willemse et al. | |
| 8,066,150 | B2 * | 11/2011 | Clarke et al. | 221/198 |
| 8,272,534 | B2 * | 9/2012 | Clarke et al. | 221/198 |
| 2006/0180234 | A1 | 8/2006 | Aylward | |
| 2006/0225383 | A1 | 10/2006 | Cobb et al. | |

* cited by examiner

Incremental Rotation

Continuous Rotation

DISPENSING CANISTER FOR DELIVERY OF SOLID MEDICATION

RELATED APPLICATIONS

The present application is a continuation-in-part of and claims priority to U.S. patent application Ser. No. 13/247,206 filed Sep. 28, 2011 now U.S. Pat. No. 8,272,534, which is a divisional application of and claims priority to U.S. patent application Ser. No. 12/477,281 filed Jun. 3, 2009 now U.S. Pat. No. 8,066,150.

FIELD OF INVENTION

The present invention relates in general to an apparatus and process for dispensing articles. In particular, the present invention relates to an apparatus and process for dispensing solid oral medication, specifically pills.

BACKGROUND OF THE INVENTION

Pharmacy automation systems that utilize a dispensing canister must be constantly recalibrated to accept solid oral medications of different shapes and sizes. Medications change size on a regular basis due to the competitive nature of the pharmaceutical industry. Each time a wholesaler or generic manufacturer releases a product at a lower cost, the pharmacy must decide if the lowered medication cost warrants the cost of recalibrating the canister. This decision impacts the consumer who depends on his or her pharmacy to provide medications at competitive prices. The present invention addresses the need to have a dispensing mechanism that can be easily modified to accept medications of various sizes.

Pill dispensers presently available in the marketplace commonly operate by a feed mechanism in the vertical direction. Such dispensers rely on gravity to assist with the processing and escapement-style singulation of pills. Gravity-fed systems have several drawbacks. In the event of the escapement-style mechanism failing, pills are free to escape from the dispenser. If the dispenser is removed and replaced onto its dispensing base, the feed mechanism may be jarred, resulting in an unintentional pill being ejected from the canister. Further to this point, no mechanism exists to prevent dispenser tampering by an individual whose goal is to abscond with medication. In contrast to conventional pill dispensers, the feed mechanism of the present invention operates substantially in the horizontal direction.

Prior art devices that dispense articles, specifically medication, are plagued by numerous problems, including failing to singulate, i.e., deliver only one object at a time, and crushing of the object, which adulterates the dispensed product. The present invention provides for effective and continual singulation. Furthermore, the present invention, through its design and method of dispensing, prevents the crushing of articles and the detrimental effects that follow after an article, such as oral medication, is crushed. Among other things, the present invention overcomes inconsistent feeding of pills, inadvertent dispensing of pills, dust, upgrading challenges, communication problems and security issues.

SUMMARY OF THE INVENTION

In a first embodiment, the apparatus and process of the present invention provides for the automated, singulated dispensing of articles, particularly solid oral medication (hereinafter generally referred to as "pills") in predetermined quantities, without human interaction. The present invention is ideal for counting medication prior to packaging of the same. The apparatus of the invention is a canister which houses a screw having a channel of a certain width and depth that corresponds to the dimensions of a particular pill type. The screw is removably mounted to the proximal and distal wall of the canister and is positioned within the canister so that it is substantially parallel to the base of the canister. That is, the screw is substantially horizontal. By virtue of being removably mounted, screws having channels of various dimensions, corresponding to a particular pill to be dispensed, can be substituted into the canister. A removable shelf and removable sidewall are separately mounted to an interior side of the canister. The sidewall extends from a top portion of the canister to a lower portion of the canister, abutting the shelf and screw. The screw traverses the canister and at the proximal end of the screw is an aperture in the canister. At the aperture in the canister, a singulation ramp is mounted which allows for pills to be dispensed one at a time.

The screw channel encases a portion of the pill. Upon rotating the screw, the pill travels along the sidewall from the distal end of the canister to the proximal end of the canister, entering the aperture and exiting the canister after passing under the singulation ramp. A rotational driver-coupling is mounted to the proximal end of the screw, allowing for activation of the canister by engaging the screw.

As is evident, the present invention allows for easy configuration and recalibration of the canister to accommodate a particular size medication. The present invention is field upgradable, that is, the user can recalibrate the device without the need to return the canister to the manufacturer to perform the reconfiguration process. The user, which can range from a pharmacist to a bulk supplier of pills, simply must replace two components: the screw and singulation ramp, and whether the user has to change the singulation ramp depends on the size and shape of the pill to be subsequently dispensed. An advantage of the present invention is that a single singulation ramp will serve its function for a range of pill sizes, thereby reducing the need to change the ramp upon changing the size of pill. This characteristic of the present invention is highly advantageous as it helps users avoid expensive shipping costs and delay in receiving medications.

Furthermore, the design of present invention allows for effective singulation of medication and overcomes mass migration of pills, problems present in the prior art. The present invention overcame significant problems during its development. For instance, with the singulation ramp, the present invention achieved singulation with a substantially horizontal screw within the canister. The horizontal position of the screw increased the number of pills that could be stored within the canister by approximately 10%. Furthermore, the inventors have found that one-sided feeding reduces, if not altogether avoids, bridging of pills between channels of the screw, avoids the need to agitate the device, and permits the screw to turn more easily in the reverse direction thereby facilitating the unjamming of pills.

Additionally, in developing the present invention, the inventors overcame inadvertent dispensing of articles. The singulation ramp was incorporated to prevent more than one pill from being dispensed from the canister at a time. In particular, the presence of the singulation ramp at a position above where the sidewall and screw meet permits only one pill at a time to pass under the ramp and continue toward the end of the canister and through the aperture. Excess pills are forced up the sloping surface of the singulation ramp and gently migrated out of the dispensing pathway. This design avoids any jamming that could occur were excess pills to encounter a flat surface, such as a singulation blade, that impeded their passage through the canister. The sloped surface of the ramp further prevents crushing of pills and instead provides an area on which there is a gentle agitation of pills.

The singulation ramp overcame additional challenges in that other devices require disassembly of the canister during research and validation of the device. In the present invention, the ramp is advantageous in that research and validation of the canister for multiple pill sizes can be performed without having to remove the ramp each time. In addition to improving the ease in which the research and validation process was completed, the present invention further permits the validation process to be conducted more quickly than when using a singulation blade.

Moreover, the method of dispensing of the present invention includes a reverse rotation of the screw which prevents pills from sitting on the precipice of the sidewall and potentially falling through the aperture of the canister.

In an effort to design a dispensing canister that is user-friendly, as well as economic, the present invention avoids the need to take the canister back to a supplier when it is time to dispense another pill type. Rather, the instant invention is field upgradable, allowing the end-user to replace the screw and ramp in order to dispense another pill type.

During development, the inventors further overcame communication challenges, thereby making the instant invention dual functioning as both a receiver and transmitter of information. In one embodiment of the present invention, for instance, the canister operates via non-contact electronic communication. In yet another embodiment, the present invention may have an illumination that provides signals to the user by virtue of it being lit, or by various colors of light, a pulsing of light, etc.

The present invention further eliminates problems with dust that were evident during the development of the invention. In one preferred embodiment, the present invention includes a dustbin. Dust poses many problems for an apparatus that dispenses articles, in particular pills, as it may clog the canister as well as coat any sensors and reduce their sensing capabilities. The substantially horizontal screw of the present invention allows for dust to fall to the base of the canister where it collects in a dustbin. The dustbin improves cleanliness and accuracy of the canister. As part of routine maintenance, the dustbin can be emptied when loading the device.

Security issues were an additional challenge overcome during the development of the present invention. Pill dispensers available in the prior art do not allow for the sealing of numerous functions of the dispenser at once. Notably, in one preferred embodiment, the present invention allows for a seal to wrap around all functions of the present invention, including the electronic storage system, aperture and external surface of the canister. Not only is such a seal tamper-evident, but it is virtually tamper-proof. Additionally, the present invention has a locking device embodied as a swing door mechanism, allowing for the dispensing canister to be safely sent to a user via first class mail or an expedited shipping service.

In an alternative embodiment, the apparatus of the present invention can dispense other items such as coins or candy. For instance, the apparatus of the present invention could be used to dispense candy or novelties in a coin (or other currency) operated machine. In a still further embodiment, the present invention could function as a proxy laboratory feed for parts on an assembly line.

A first method of the present invention dispenses articles of a predetermined size and shape, specifically pills, by activating a driver-coupling connected to a screw having a channel of a predetermined width and depth corresponding to the dimensions of said article; rotating said screw; and stopping the rotation of said screw upon detection of an article drop. In a highly preferred embodiment, after the screw stops rotating in the forward direction, the screw is then reversed a fraction of a turn, which prevents a pill from falling off the precipice, thereby reducing inadvertent dispensing. These steps are repeated until a predetermined number of pills are dispensed. This method of dispensing ensures singulated delivery of the pill, while minimizing, if not eliminating, the chances that a pill will jam or be crushed.

BRIEF DESCRIPTION OF THE DRAWINGS

Having thus described the invention in general terms, reference will now be made to the accompanying drawings, which are not necessarily drawn to scale.

Figure 1:
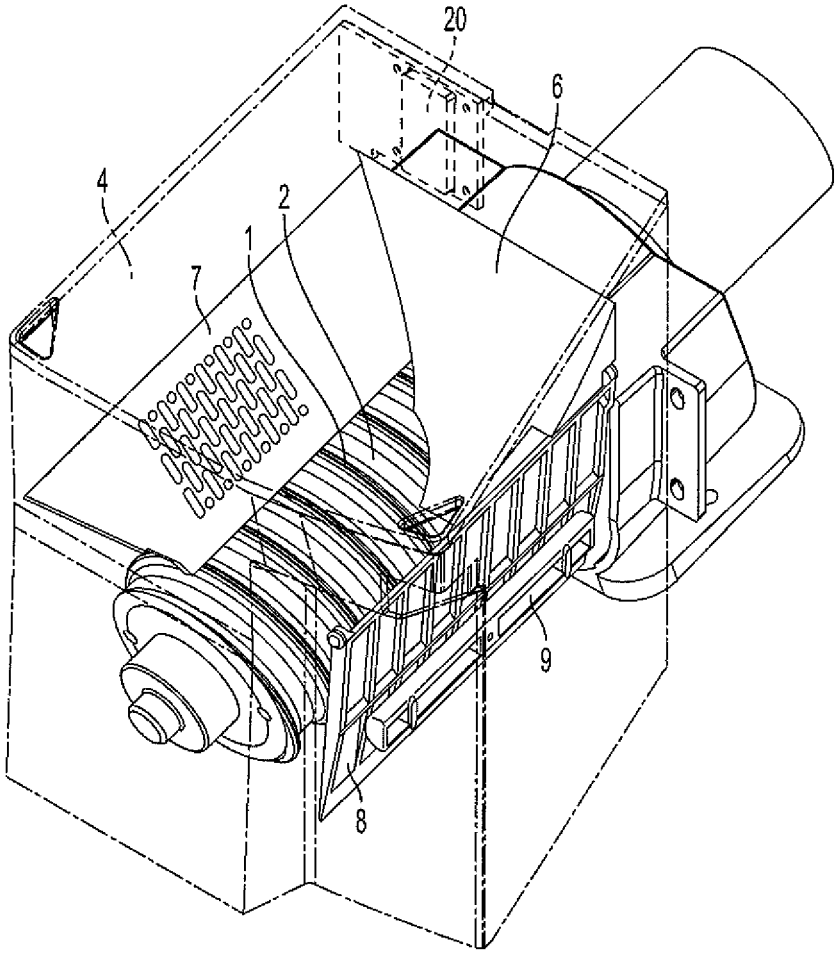

FIG. 1 is a top isometric view of an assembled canister.

Figure 2:
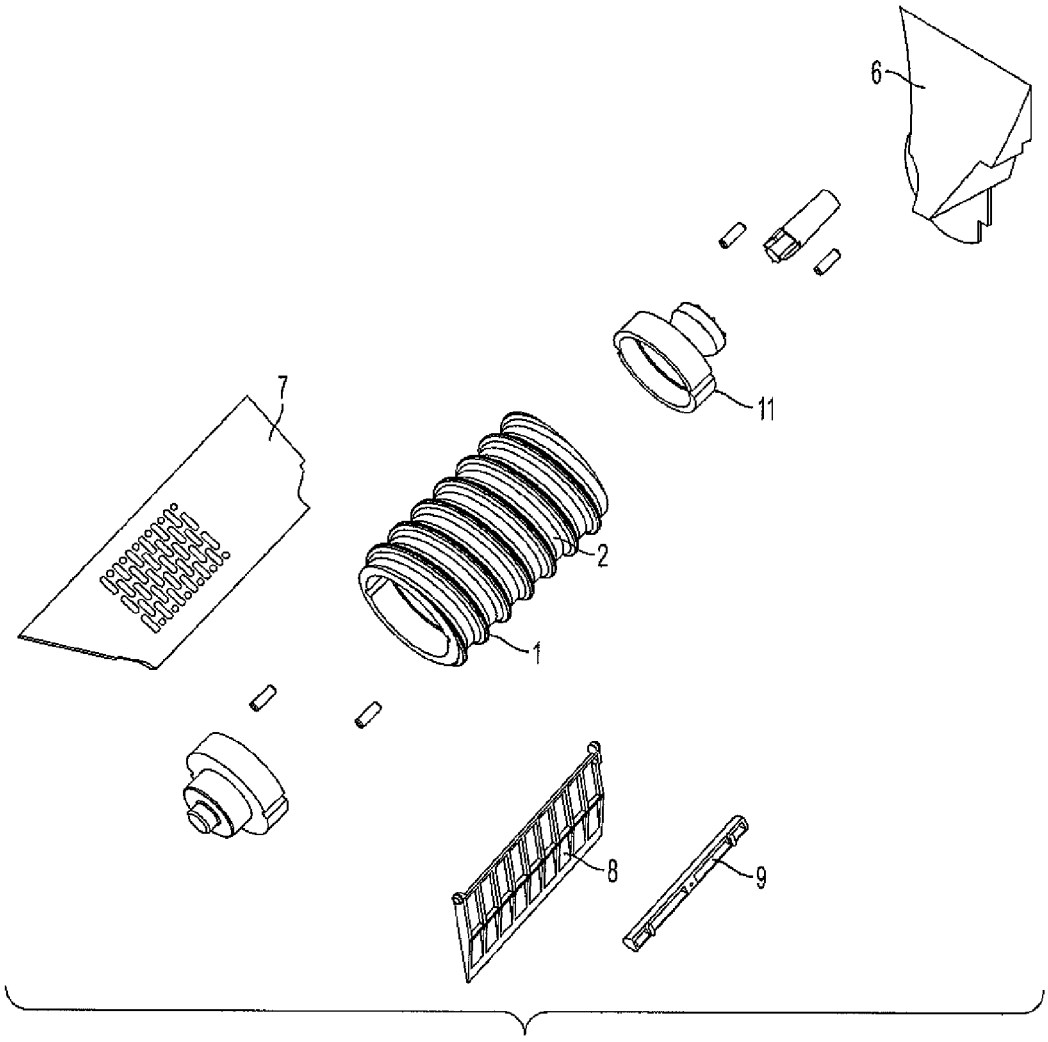

FIG. 2 is an exploded view of several elements of a canister.

Figure 3:
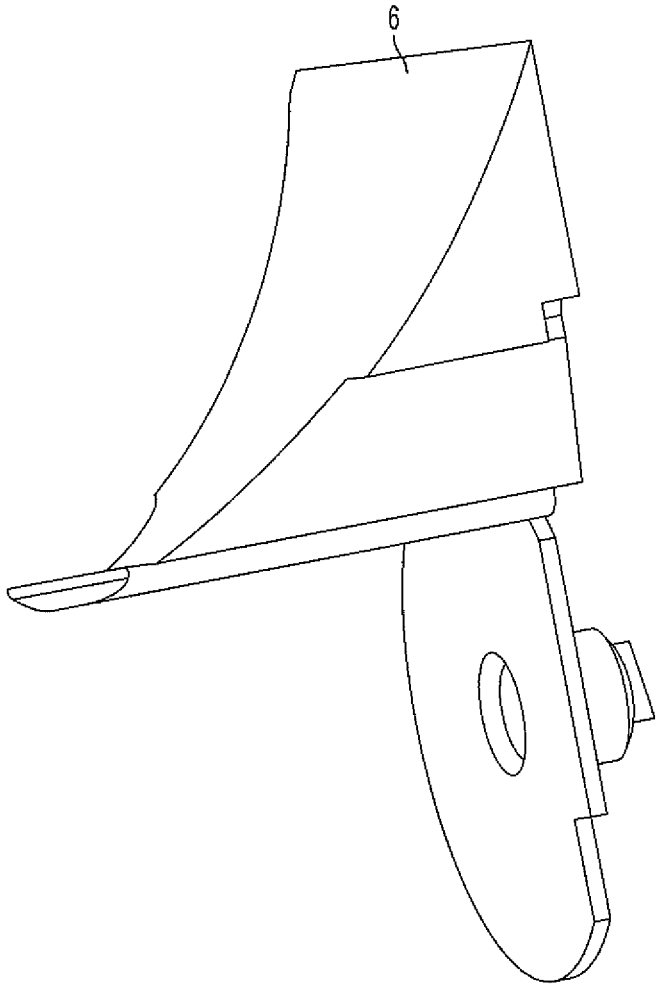

FIG. 3 is a side, isometric view of a singulation ramp.

Figure 4:
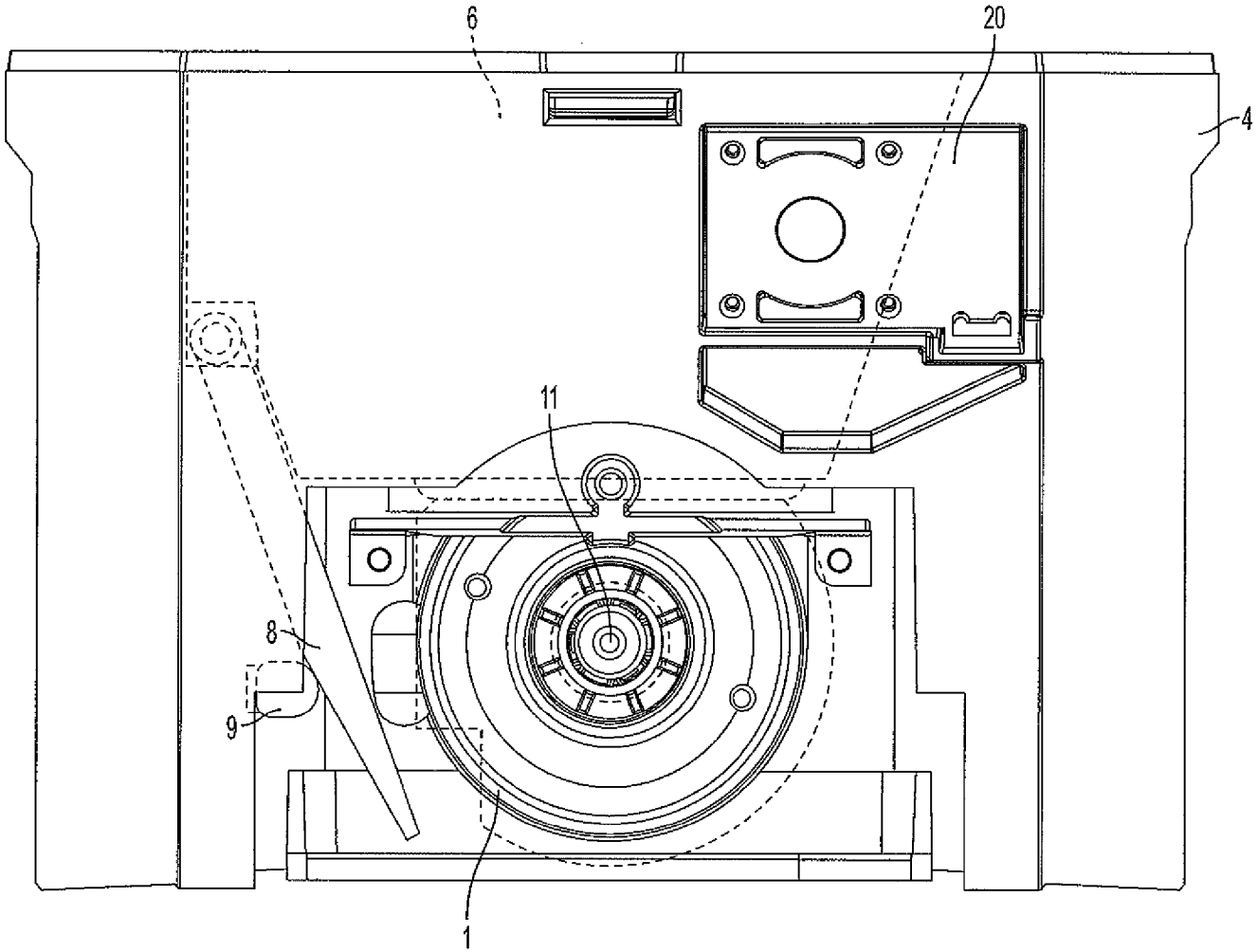

FIG. 4 is an enlarged front view of the proximal end of a screw within a canister.

Figure 5A:
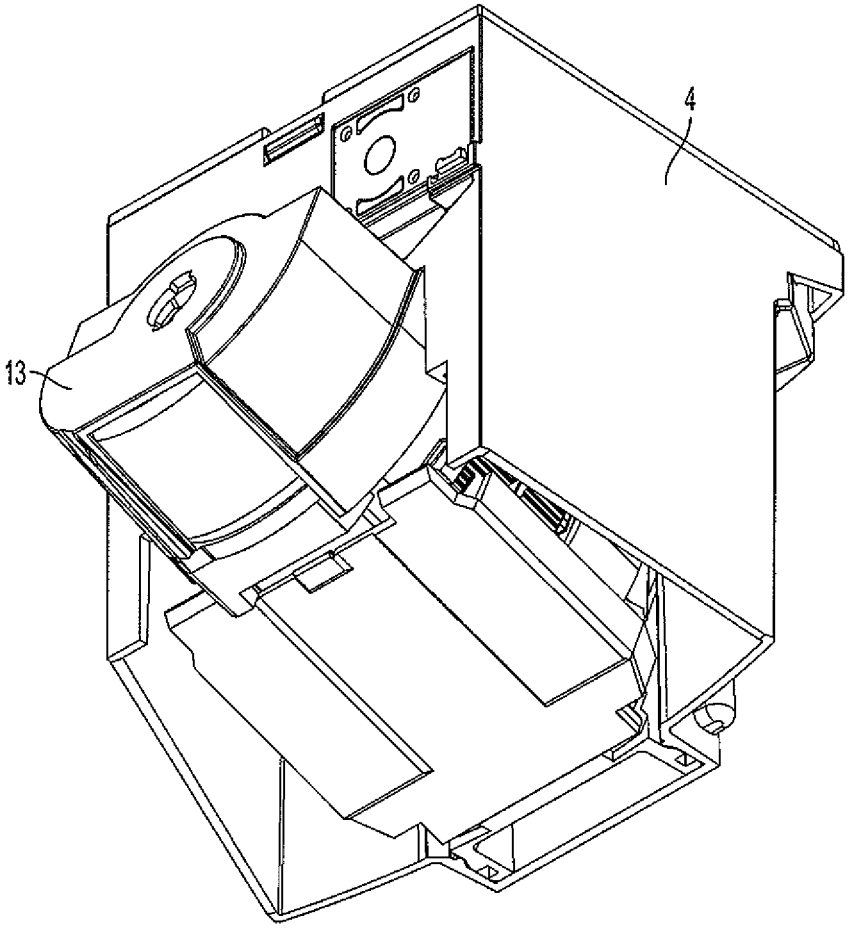

FIG. 5A is a rear isometric view of the lower, proximal end of the canister, in closed position.

Figure 5B:
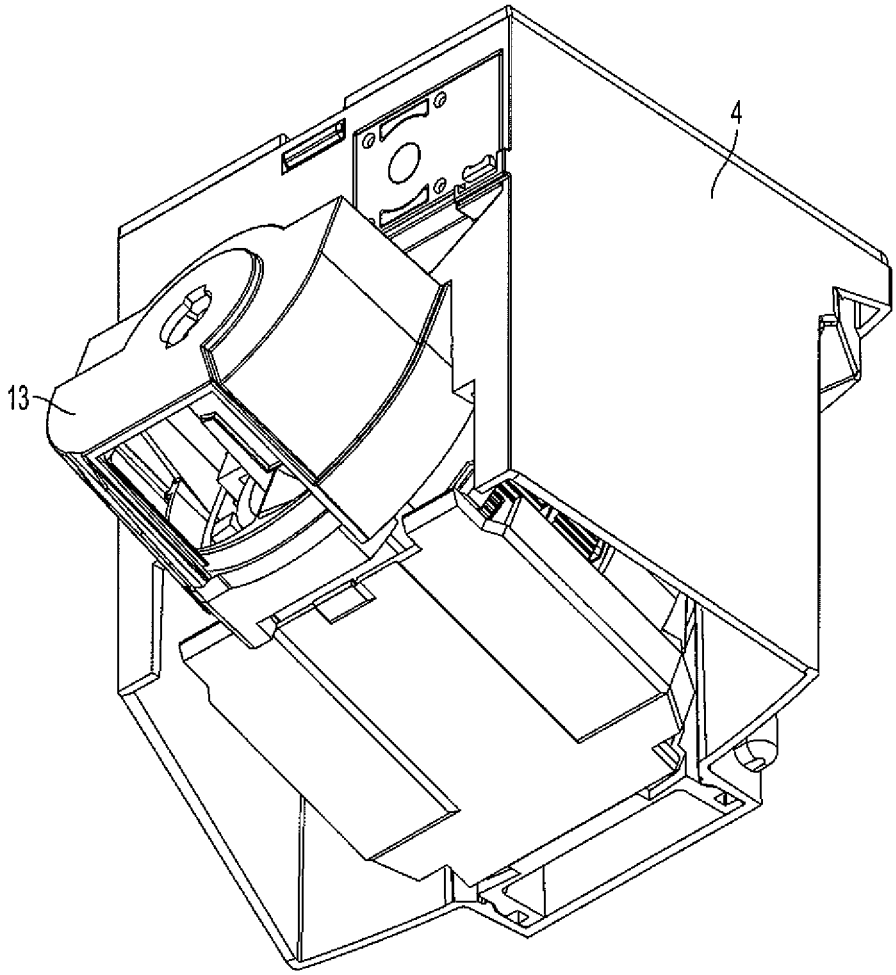

FIG. 5B is a rear isometric view of the lower, proximal end of the canister, in open position.

Figure 6:
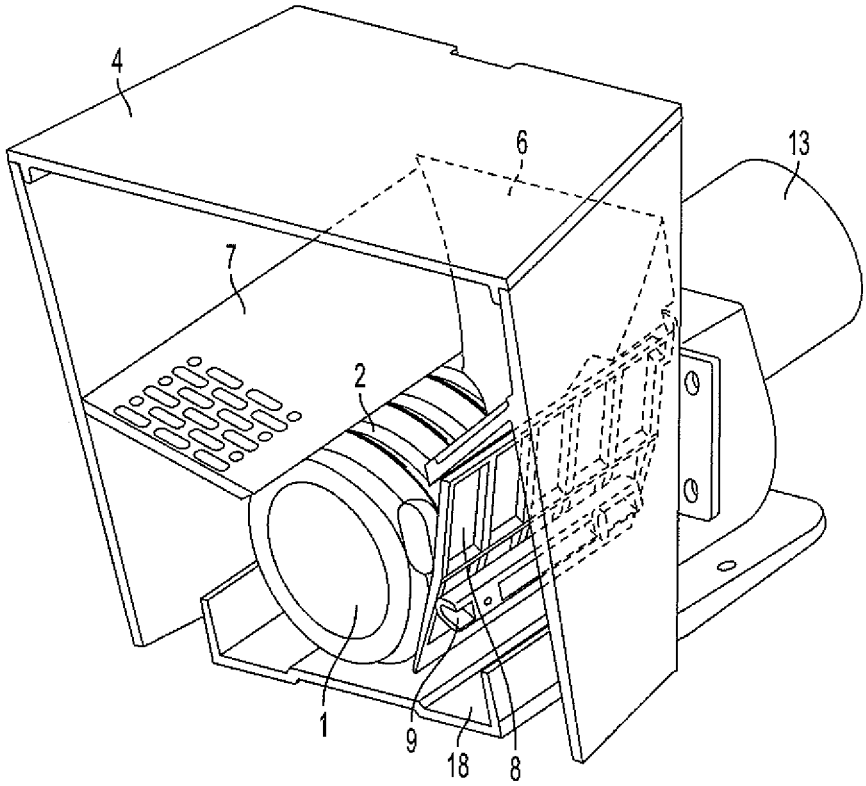

FIG. 6 is a side isometric view of the proximal end of an assembled canister.

Figure 7:
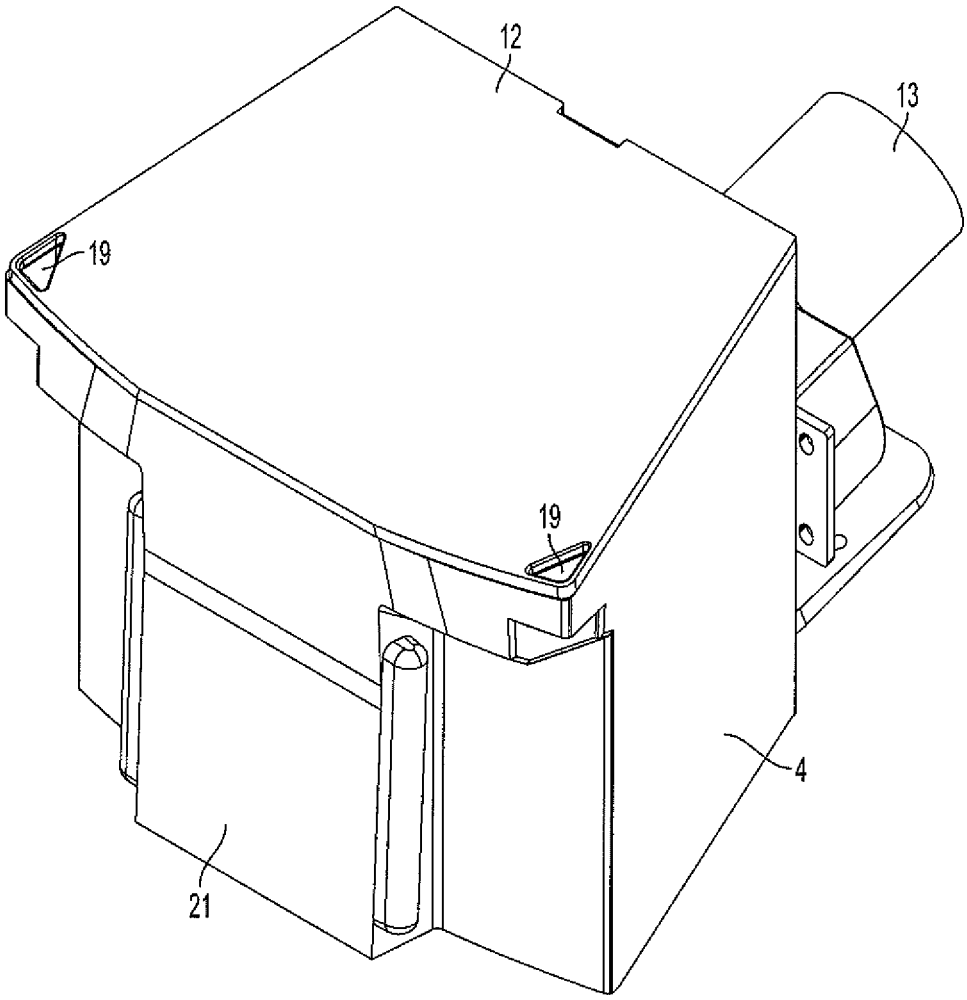

FIG. 7 is a top isometric view of an assembled canister which has been tamper-sealed.

Figure 8:
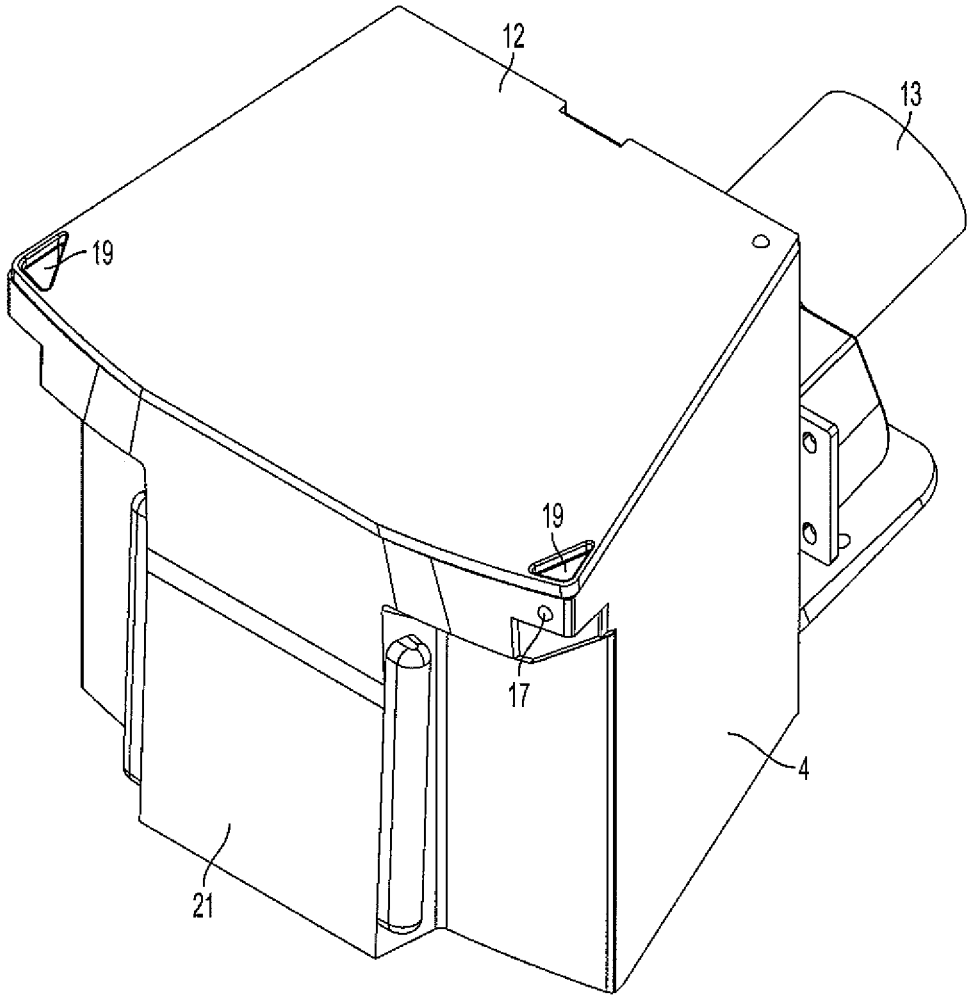

FIG. 8 is a top isometric view of an assembled canister containing an illumination.

Figure 9:
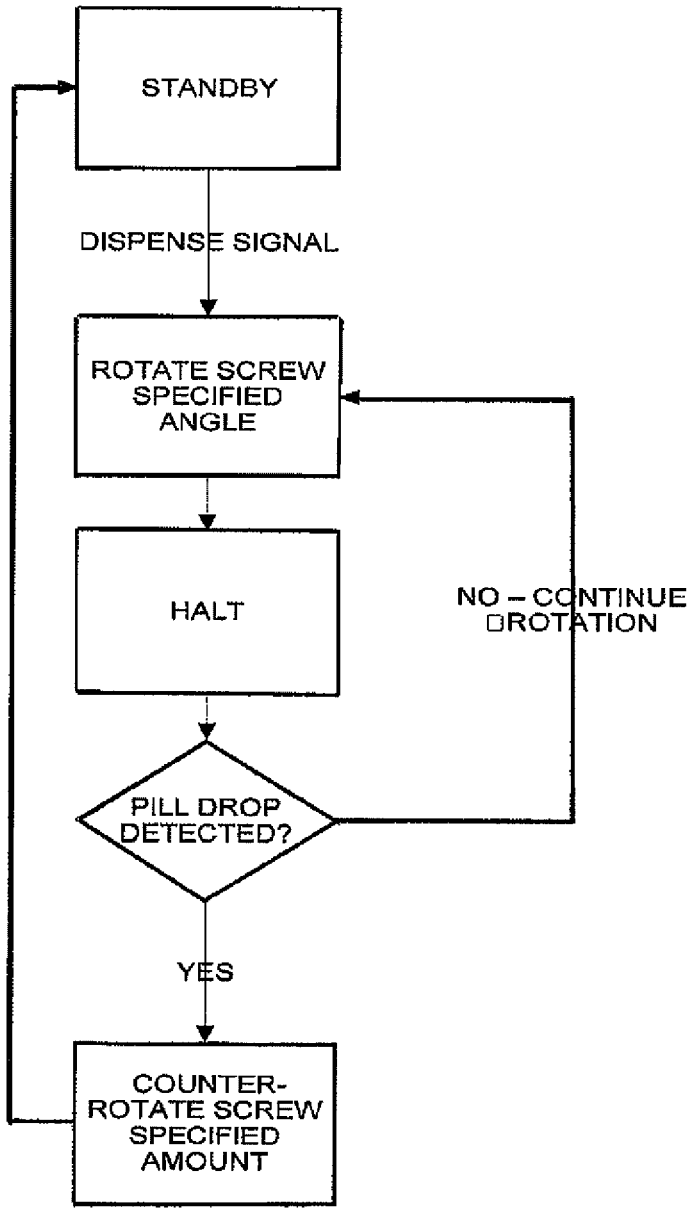

FIG. 9 shows a flowchart diagram illustrating dispensing of pills by way of an incremental rotation of the screw.

Figure 10:
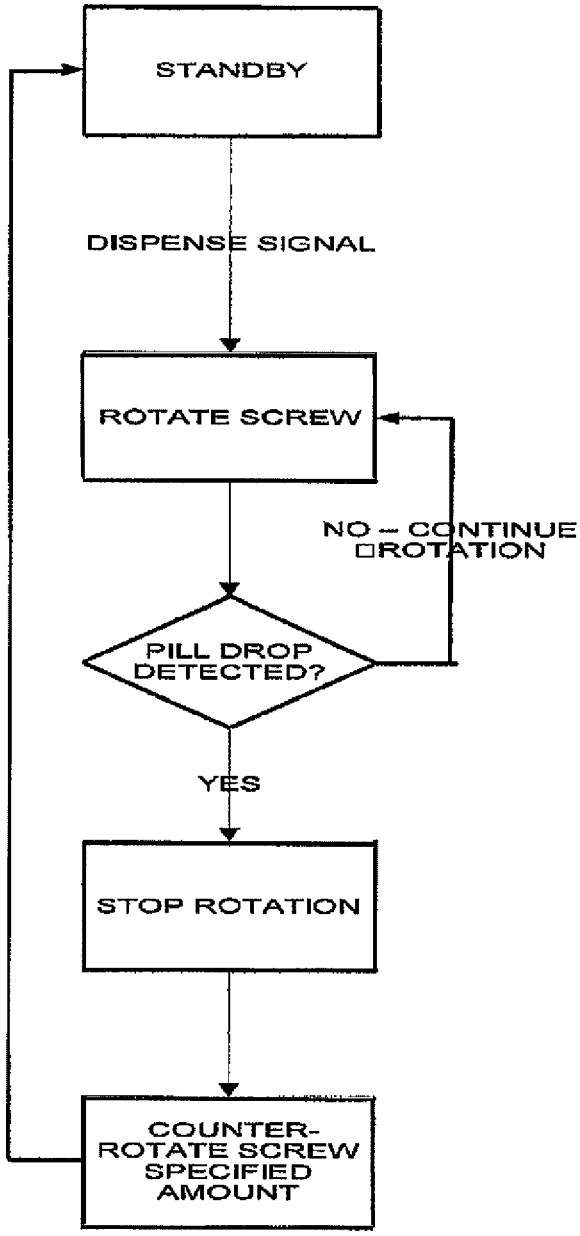

FIG. 10 shows a flowchart diagram illustrating dispensing of pills by way of a continuous rotation of the screw.

DETAILED DESCRIPTION OF THE INVENTION

The present invention now will be described more fully hereinafter with reference to the accompanying drawings, in which some, but not all embodiments of the invention are shown. Any embodiment described is only an example of one embodiment and should not be interpreted to limit any of the claims. Like numbers refer to like elements throughout.

Generally speaking, the present invention provides an apparatus and method for the singulated dispensing of articles, particularly pills of various sizes and shapes. The apparatus of the invention is a canister which houses a removably mounted screw having a channel of a certain width and depth that corresponds to the dimensions of a particular pill. Depending on the particular pill to be dispensed, the screw can be substituted so that a screw with an appropriately sized channel is incorporated. A removable shelf is mounted to an interior side of the canister. A removable sidewall is also mounted to an interior side of the canister, extending from a top portion of the canister to a bottom portion of the canister. The sidewall abuts both the shelf and the screw. The angle of the sidewall can be adjusted to accommodate certain pill sizes by changing the height of the shelf. Upon rotation of the screw, the screw channel encases a portion of the pill, and the pill travels along the sidewall from the distal end of the canister to the proximal end of the canister, entering an aperture at the proximal end and exiting the canister after passing under the singulation ramp. A rotational driver-coupling is mounted to the proximal end of the screw, allowing for activation of the canister by engaging the screw. The method of the present invention dispenses pills by activating the driver-coupling which rotates the screw, and, upon detection of a pill drop, in one preferred embodiment, the screw is reversely rotated a fraction of a turn. These steps are repeated until a predetermined number of pills are dispensed.

FIG. 1 is a top isometric view of an assembled canister. The embodiment illustrated in FIG. 1 includes a screw 1, having a distal and a proximal end. On the external surface of the screw 1 traverses a channel 2 of a predetermined width and depth which corresponds to the dimensions of a particular item to be dispensed (in a first embodiment, the items is a medicant such as a pill, capsule or tablet). The screw 1 is removably mounted to the proximal and distal walls of the canister. The screw 1 sits within the canister 4 and is substantially parallel to the base of the canister 4. Further, the screw 1 abuts the distal wall of the canister 4, as well as an aperture (not pictured) in the proximal wall of the canister 4. "Abuts" as used herein does not mean to make a point of contact or to touch, but rather means to be close enough to another object such that the gap between the two parts is sufficiently small so as not to prevent the device from fully functioning. For instance, the gap is too small to permit the item being dispensed to fall through it.

FIG. 1 further includes a sidewall 8 which removably connects to an interior wall of the canister 4. A removable sidewall shelf 9 is mounted to an interior side of the canister 4. More specifically, the sidewall shelf 9 abuts the sidewall 8, both of which are connected to the wall of the canister 4. The sidewall 8 extends from a top portion of the canister to a bottom portion of the canister. The sidewall shelf 9 preferably runs the length of the screw 1. The sidewall 8 abuts both the sidewall shelf 9 and screw 1, and provides a passageway along which the pills may travel through the canister. The position of the sidewall shelf 9 can be adjusted, thereby affecting the angle of the sidewall 8, so that only one pill passes under the singulation ramp at a single time. For instance, a tall setting of the sidewall shelf would be ideal for small, round pills, while the shelf would need to be adjusted downward for a gel cap in order for the medicine to get past the singulation ramp.

Near the proximal end of canister 4 is a singulation ramp 6. The singulation ramp 6 is positioned above where the sidewall 8 abuts the screw 1 so that only a single pill can continue under the ramp 6 and down the sidewall 8 while the screw 1 continues to turn. The singulation ramp may vary in shape, material, slope, etc.

In the preferred embodiment shown in FIG. 1, the invention further contains a perforated wall 7. In this preferred embodiment, the perforated wall 7 is affixed to an interior wall of the canister 4 at an angle so that it directs pills toward the screw 1 when the canister is loaded. In a more preferred embodiment, the sidewall 8 and sidewall shelf 9 are placed on the opposite side of the canister from the location of the perforated wall 7. In a more preferred embodiment, the perforated wall 7 comes down and rests on top of or just above the screw 1. The perforations help direct dust to the bottom of the canister so as not to interfere with dispensing.

In a highly preferred embodiment, about 25-65% of the width or diameter of the pill is contained within the screw channel 2 and the remainder is in the air gap between the most external portion of the screw 1 and the sidewall 8.

Another highly preferred embodiment contains a desiccant holder, which may be positioned behind the perforated wall. A further highly preferred embodiment includes a removable container within the canister that contains a sample of the pills being dispensed. The sample material may then be used for testing at a later date.

FIG. 1 additionally includes a rotational driver-coupling (not pictured) which is mounted to the proximal end of the screw 1. The rotational driver-coupling can be any conventional structure that permits a mechanism external to the canister to rotate the screw within the canister of the present invention.

The preferred embodiment illustrated in FIG. 1 also includes an electronic storage system 20. Unlike the limited memory available on presently available dispensing systems, the electronic storage system 20 of the present invention can store a range of information, which can be classified into two categories: identifying information and peripheral information. Identifying information includes information specific to the canister, including but not limited to, for example, the serial or model number of the canister, the manufacturer, the year of manufacture and the date of last inspection. Peripheral information includes all other information, including but not limited to, for example, the physical location of the canister, medication-specific information, such as the name of the medication, the active ingredient, the lot number, and the expiration date. Information regarding the location of the canister would include chain of custody information, which is useful to confirm the safety and integrity of the medication. In another preferred embodiment, the electronic storage system includes a counter. The counter can communicate with a sensor at or near the aperture in the canister in order to identify when a pill exits the canister. The sensor is activated every time it senses a pill drop and then transmits a message to the counter to increase its count by one. The counter can further be linked to the rotational driver-coupling, so that upon the counter reaching a predetermined number the driver-coupling is deactivated. In a further preferred embodiment, a receptacle is connected to the external wall of the canister below the aperture. The receptacle can be of a curved nature that would funnel the pills to the base of a packager. A pill drop detection sensor can be placed on or near the receptacle in order to easily register a pill drop.

The present invention, for which one preferred embodiment is illustrated in FIG. 1, does not appear in the prior art and provides a new dispensing mechanism that can be easily modified to dispense medications of various sizes. As seen in patents such as U.S. Pat. Nos. 4,560,086 and 4,759,469, dispensing articles through the use of a helical tool is known in the art. More specifically, U.S. Pat. No. 5,884,806 ("the '806 patent") allegedly discloses a system for dispensing a variety and range of pills of various shapes and sizes through the use of plurality of standardized modules, including a tube containing a helical, interior ridge. Quite the opposite, the screw of the present invention has a channel on its external surface. While the invention of the '806 patent dispenses different pill sizes by adjusting the speed of the screw-type feed and dispensing mechanism, the present invention utilizes a screw, sidewall shelf and sidewall particular to a specific pill size. The dispenser disclosed in the '806 patent feeds pills to the helix-tube via a trough which contains the supply of tablets. Yet, the screw of the present invention is hopper-fed. Furthermore, the invention of the '806 invention allegedly achieves singulation through interior shapes that cause backward tumbling. The instant invention achieves precise singulation at all times through the use of two mechanisms within the canister. First, the screw channel of a certain width and depth has a predetermined width that allows for encasing of only one pill at any point along the channel. These preset dimensions prevent bridging of pills, whereby a pill may cross two threads of a channel which could result in a pill jam. Second, a singulation ramp ensures singulation as the pills exit the canister. In contrast, pills dispensed from the '806 invention simply "typically" exit only one at a time.

In an alternative preferred embodiment, the pills may be dispensed from the distal end of the canister. The arrangement of the screw within the canister does not change; however, in this embodiment, the screw abuts an aperture in the distal wall of the body of the canister. As a result, the singulation ramp is mounted near the distal end of the canister. The rotational driver-coupling is further mounted near the distal end of the screw.

In another preferred embodiment, the singulation ramp is long enough to recirculate pills into the general area of pill migration. In a further preferred embodiment, there is a curvature to the ramp. In a highly preferred embodiment, the ramp extends to the top of the canister.

In another preferred embodiment, the canister includes a non-contact infrared interface powered by a transformer coupling from an electromagnet in the hollow body. The interface transfers electrical power by inductive (i.e., mutual) coupling. In an additional preferred embodiment, the canister includes a receiver which is capable of retrieving instructions from an external computer. The receiver and the external computer can communicate by radio frequency, infrared, wire, magnetic and fiber optics. Instructions that the canister may obtain through the receiver includes but is not limited to the number of pills to be dispensed, the rate at which pills should be dispensed, or the number of times a batch of a certain number of pills should be dispensed. Additionally, the receiver could be complimented by a controller device capable of issuing commands. Therefore, according to this preferred embodiment, the canister is dual-functioning: able to send and receive commands. Potential controller devices may be an embedded computer or transmitter.

In a further preferred embodiment, the canister comprises a power connection. The power connection could include a direct electrical connection, an onboard power source, and a coupled non-contact transformer which is housed in the canister. A continuous power connection is useful for a canister embodiment that incorporates an electronic storage system. Potential onboard power sources may include a battery, an electrochemically generated source or a fuel cell.

In another preferred embodiment, the driver-coupling is bidirectional. As previously mentioned, the method of the present invention calls for the screw to be rotated in the forward direction as it dispenses pills, and then upon detection of a pill drop, the screw stops rotating. In one highly preferred embodiment, the screw next rotates in the reverse direction. The method of the present invention includes a reverse rotation of the screw for a fraction of a turn so as to prevent the next pill from mistakenly being dispensed by removing the pill from the precipice.

In an additional preferred embodiment, the canister further comprises a rotational driver connected to the rotational driver-coupling. The driver may be a frictional driver.

FIG. 2 is an exploded view of several elements of a canister. FIG. 2 includes a screw 1 with a channel 2 having a predetermined width and depth corresponding to a particular pill type. The screw 1 sits within the canister 4 through attachments at both the proximal and distal end. Near the proximal end of the canister 4 is positioned a singulation ramp 6. A sidewall 8 is removably attached to an interior side of the canister 4, extending from a top portion of the canister to a bottom portion of the canister. The sidewall 8 may be positioned at an angle such that it abuts the screw 1 when the canister is fully assembled. A sidewall shelf 9 is removably attached to the canister 4 and runs substantially parallel to the screw 1. The sidewall shelf 9 may be held in place by a screw which is positioned on the external side of the canister. A perforated wall 7 is attached to the canister and directs pills toward the screw 1. A rotational driver-coupling 11 is mounted to the proximal end of the screw 1. When the coupling 11 is activated, it engages the screw 1, causing it to rotate. The rotating screw 1 picks up pills from the hopper and dispenses them on a singulated basis.

The canister of the present invention dispenses one pill type at a time. When the user wishes to dispense a different pill type, the dispensing canister can easily be recalibrated by replacing just two of the parts appearing in FIG. 2: the screw 1 and singulation ramp 6. These parts can easily be removed by human touch or with the assistance of a flat-head screwdriver. The user can then consult a recalibration manual, chart, kit or the like to determine which screw 1 and ramp 6 should be incorporated into the canister for a specific pill type. Each screw 1 will have a channel 2 of a certain width and depth that will be appropriate to fit a specific pill type. After selecting the proper screw 1 and singulation ramp 6, the user simply has to snap these components back into the canister. The user could consult reference material, such as a table, manual or the like, to determine whether the height of the sidewall shelf 9 should be modified. Recalibration is then complete and the canister is ready to dispense and count a different pill type.

FIG. 3 is a side, isometric view of a singulation ramp 6. While not drawn in its entirety, the singulation ramp 6 shown in this preferred embodiment would be placed at the proximal end of the canister 4 near the aperture where pills are dispensed from the canister. The singulation ramp 6 may be made of varying sizes and slopes in order to accommodate and singulate varying sizes of pills. In a highly preferred embodiment, three sizes of singulation ramps will effectively singulate the complete range of pill sizes.

FIG. 4 is an enlarged front view of the dispensing end of a screw within a canister 4. In this additional preferred embodiment, a screw 1 sits within the canister 4, the screw being substantially parallel to the base of the canister. In this preferred embodiment, a sidewall 8 is removably attached to the interior wall of one side of the canister 4. The sidewall 8 has an inclined slope. A sidewall shelf 9 is removably mounted to an interior side of the canister 4. Once the pills are loaded into the canister, they lodge in the channel and the hopper of the canister. When the screw is rotated, the pills move from the distal end of the canister to the proximal end of the canister. As is illustrated, pills (depicted as a capsule) travel along the sidewall 8 as the screw 1 is rotated by the rotational driver-coupling 11. While the screw 1 is rotated, the channel 2 guides the pills down the sidewall 8 from the distal to the proximal end of the canister. The sidewall 8 buttress the pill against the screw 1 for conveyance purposes, thus forming a pill feed pathway. A single pill then passes under the singulation ramp 6 at a single point in time.

FIG. 5A is a rear isometric view of the lower, proximal end of the canister, in closed position. FIG. 5B is a rear isometric view of the lower, proximal end of the canister, in open position. In each preferred embodiment, a divider with swing door mechanism 13 is connected to the lower, proximal end of the canister 4. Specifically, the divider with swing door mechanism 13 covers the aperture in the proximal wall of the canister. The swing door mechanism 13 is intended to be in the closed position, as depicted in FIG. 5A, during any time the canister is not in use, i.e., when the driver-coupling is not activated, whether it be while in the pharmacist's office or when the device is being shipped to a recipient. The swing door mechanism 13 prevents any lose pills from being unintentionally dispensed from the canister. The swing door mechanism 13 further adds a tamper-proof component to the canister. As medication stored within the canister can be of significant value, it is ideal to prevent unwanted persons from gaining access to the pills within the canister. The swing door mechanism 13 is opened and closed by activation of the rotational driver-coupling. When the driver-coupling is activated, the swing door mechanism 13 opens. Before operating the canister described in this embodiment, the locking mechanism, pictured in the center of the swing door mechanism 13, must be put in its open position.

FIG. 6 is a side isometric view of the proximal end of an assembled canister. This preferred embodiment includes a screw 1, having a channel 2 of a predetermined width and depth which corresponds to the dimensions of a particular pill. The screw 1 is removably mounted within in the canister 4. Near the proximal end of the canister 4 is a singulation ramp 6. In this preferred embodiment, the sidewall 8 is angled toward the screw 1. In a more preferred embodiment, the perforated wall 7 is opposite the sidewall 8. The canister as illustrated in FIG. 6 can be simply loaded by opening a top surface, i.e., a lid, and pouring a bulk supply of pills substantially into the center of said canister. The pills then cascade down perforated wall 7 and are directed toward the screw 1, i.e., the screw is hopper-fed. Pills are individually selected by restricting entry of the pills into the channel based upon three dimensions of depth, width and length. Only a single pill (pictured as an oval) can occupy a particular spot on the sidewall 8 and within the appropriately sized channel 2 at one time. As the screw is rotated, pills will travel down the passageway created by the screw 1 and sidewall 8. By virtue of the helical channel, no pill will approach the proximal end of the screw 1 at the exact same time. As each pill approaches the proximal end of the screw 1, a single pill will pass under the singulation ramp 6 and exit an aperture in the canister 4.

In another preferred embodiment, the ramp is made of food-grade plastic. In a further preferred embodiment, the canister, screw, sidewall, and shelf are made of USP-grade plastic. It is ideal that the components of the present invention be made of materials that would not contaminate or degrade the articles being dispensed from the canister, especially medication which is likely being ingested by a person who is ill.

In an additional preferred embodiment, the canister includes a dustbin 18. A dustbin collects and gathers any dust or other sediment that many come off the pills while they are stored in the canister 4 or dispensed. It is ideal to have a dustbin that stores the dust, so that it is contained in one area and reduces the possibility of dust interfering with the activation and rotation of the screw 1 or any other component within the canister 4, in particular any sensor(s).

FIG. 7 is a top isometric view of an assembled canister which has been tamper-sealed. As previously mentioned, medication may be of significant value and the canister of the present invention could attract unwanted persons who seek to misuse such medication. In this preferred embodiment, a lid 12 is affixed to the canister 4. In one preferred embodiment, the lid may be connected to the canister by a hinge. In another preferred embodiment, the lid may be permanently affixed to the canister. Similarly, in additional preferred embodiments the canister may have a bottom that is connected to the canister by a hinge or permanently affixed. In this embodiment, a tamper-evident seal 19 is placed on the top corners of the lid 12. In additional preferred embodiments, tamper-evident seals can cover any portion of the canister 4. In a highly preferred embodiment, tamper-evident seals cover all ingress components of the canister 4 making it tamper-proof. The tamper-evident seal could be made from plastic, metal or a combination thereof. During transport of the canister, a lid 12 and tamper-evident seals 19 can be added to the canister 4 to prevent someone from opening the canister 4. Should the lid or seal be tampered with, it would be evident to the recipient of the canister, and he or she would know not to use the medication contained therein because it was potentially compromised.

Also illustrated in FIG. 7 is a handgrip 21. In one preferred embodiment of the present invention, the handgrip 21 is T-shaped and provides for easy removal of the canister from its location on a shelf, base or the like. In another preferred embodiment, the handgrip 21 has pads along its side to allow for easy gripping.

In another preferred embodiment of the present invention, the canister is about 0.1 L to 4.0 L in volume.

FIG. 8 is a top isometric view of an assembled canister containing an illumination. The illumination 17 is attached to the external surface of the canister and connected to a sensor within said canister. The illumination 17 is a light or a beacon. It can provide various signals to the user. For example, the illumination can indicate whether there is a sufficient supply of pills, thereby illuminating when the canister is empty. The illumination could also indicate whether the canister's battery is low. As another example, the illumination could further indicate whether the pills are at or near expiration date. The illumination could convey any number of complications. Different colors of the illumination could also indicate a certain pill type. Simply the activation of the illumination could convey a signal, or different colors of illumination could indicate various signals.

FIG. 9 shows a flowchart diagram illustrating one preferred embodiment for dispensing of pills by way of an incremental rotation of the screw. This method includes the steps of: (a) activating a driver-coupling 11 connected to a screw 1 having a channel 2 of a predetermined width and depth corresponding to the dimensions of said article; (b) rotating said screw a predetermined number of degrees; (c) removing a second article from said channel; (d) repeating step (b) until detection of an article drop; and (e) stopping the rotation of said screw upon detection of an article drop. In a highly preferred embodiment, the stopping of the rotation of the screw is followed by reversing the rotation of said screw a fraction of a turn. In a more highly preferred embodiment, the screw is reversed 45 to 90 degrees. In general, the number of degrees for which the screw is reversed depends on the pitch of the screw. This aforementioned dispensing method differs from method of dispensing disclosed in the '806 patent from the standpoint of singulation. The invention described by the '806 patent cannot predict the angular rotation required to eject a pill, due to the reverse tumbling action relied upon for singulation. The invention of the '806 patent must continually churn its helical screw until a pill is detected having left its channel. The aforementioned steps of a preferred embodiment of the invention, including the reverse rotation after detection of a pill drop, are repeated until a predetermined number of articles is dispensed FIG. 10 shows a flowchart diagram illustrating one preferred embodiment for dispensing pills by way of a continuous rotation of the screw. This method includes the steps of: (a) activating a driver-coupling 11 connected to a screw 1 having a channel 2 of a predetermined width and depth corresponding to the dimensions of said article; (b) removing a second article from said channel; (c) rotating said screw until detection of an article drop; and (d) stopping the rotation of said screw upon detection of an article drop. In a highly preferred embodiment, the stopping of the screw is followed by reversing the rotation of said screw a fraction of a turn. These steps are repeated until a predetermined number of articles are dispensed.

In another preferred embodiment, the continuous rotation method can be utilized, but additional steps can be added to prevent pill jamming and subsequent destruction of the pill. Accordingly, steps (a) through (d), in addition to the reverse rotation of the screw after each pill drop, can be repeated until a predetermined number of articles are dispensed or until detection of increased torque applied to the screw. Should increased torque need to be applied to the screw in order to rotate, it means that something is interfering with the pills' progression down the sidewall shelf or under the singulation ramp. It is prudent that the screw not continue to rotate in such a situation because it will likely result in the crushing of a pill or multiple pills. This is an undesired result because it will result in wasted medication and could also cause significant dust and debris to accumulate in the canister. Accordingly, for this preferred embodiment, the dispensing of pills will halt upon detection of an increase in torque. This method essentially allows for clearing of a pill jam.

In an additional preferred embodiment, should there be a detection of an increase in torque, because of a pill jam or the like, the following steps should be followed: reversing the rotation of said screw a fraction of a turn upon detection of increased torque applied to said screw; and repeating the steps of the continuous rotation method until a predetermined number of articles is dispensed or until detection of increased torque applied to said screw. In this embodiment, upon detection of an increase in torque, the screw is rotated in the reverse direction in order to dislodge the jam. This allows for the dispensing of the pills to continue after the pill(s) is dislodged.

We claim:

1. A canister for dispensing an article of a predetermined size and shape, comprising:

a. A screw, said screw having a distal and a proximal end;

b. A channel on the external surface of said screw, said channel being of a predetermined width and depth corresponding to the dimensions of said article;

c. A hollow body having a base surface, said body adapted to receive said screw mounted in a position substantially parallel to said base surface wherein:

i. the distal end of said screw abuts a distal wall of said body, and ii. a proximal end of said screw abuts an aperture in a proximal wall of said body;

d. A singulation ramp mounted within said body near the proximal end of the screw;

e. A removable shelf mounted to an interior side of said hollow body;

f. A removable sidewall mounted to an interior side of said hollow body that terminates near said screw; and g. A rotational driver-coupling mounted to the proximal end of the screw.

2. The canister of claim 1 further comprising an electronic storage system, which stores information comprising at least one of the group consisting of identifying information and peripheral information.

3. The canister of claim 2 wherein said electronic storage system contains a counter.

4. The canister of claim 2 further comprising a non-contact infrared interface powered by a transformer coupling from an electromagnet in the hollow body.

5. The canister of claim 2 wherein said canister further comprises a receiver capable of retrieving instructions from an external computer.

6. The canister of claim 5 wherein said computer communicates with the receiver via methods selected from the group consisting of radio frequency, infrared, wire, magnetic and fiber optics.

7. The canister of claim 1 further comprising a power connection.

8. The canister of claim 7 wherein the power connection is selected from the group consisting of a direct electrical connection, an onboard power source, and a coupled non-contact transformer, which is housed in said hollow body.

9. The canister of claim 5 wherein said canister further comprises a controller device capable of issuing commands.

10. The canister of claim 1 wherein said shelf positioned near the proximal end of said screw extends approximately the length of said screw.

11. The canister of claim 1, wherein said aperture in the proximal wall of said hollow body is covered by a swing door mechanism that opens when said driver-coupling is activated.

12. The canister of claim 1 wherein said hollow body has a perforated wall that terminates near said shelf.

13. The canister of claim 1 wherein said hollow body has at least one container removably mounted to an interior wall.

14. The canister of claim 1 wherein the driver-coupling is bidirectional.

15. The canister of claim 2 wherein said peripheral information includes the location of the canister, medication information, lot number and expiration date for articles housed in said canister.

16. The canister of claim 1 further comprising a tamper-evident seal.

17. The canister of claim 1 further comprising a lid that is connected to said hollow body by a hinge.

18. The canister of claim 1 further comprising a lid that is permanently affixed to said hollow body.

19. The canister of claim 1 further comprising a bottom that is connected to said hollow body by a hinge.

20. The canister of claim 1 further comprising a bottom that is permanently affixed to said hollow body.

21. The canister of claim 1 wherein a receptacle is connected to the external wall of said hollow body below the proximal aperture.

22. The canister of claim 1 further comprising a pill drop detection sensor.

23. The canister of claim 1 wherein said hollow body is about 0.1 L to 4.0 L.

24. The canister of claim 1 further comprising a rotational driver connected to said rotational driver-coupling.

25. The canister of claim 1 further comprising an illumination attached to the external surface of said hollow body and connected to a sensor within said canister.

26. A canister for dispensing an article of a predetermined size and shape, comprising:

a. A screw, said screw having a distal and a proximal end;

b. A channel on the external surface of said screw, said channel being of a predetermined width and depth corresponding to the dimensions of said article;

c. A hollow body having a base surface adapted to receive said screw mounted in a position substantially parallel to said base surface wherein:

i. the distal end of said screw abuts a distal wall of said body, and ii. a proximal end of said screw abuts an aperture in a proximal wall of said body;

d. A singulation ramp mounted within said body near the proximal end of the screw;

e. A removable shelf mounted to an interior side of said hollow body;

f. A removable sidewall mounted to an interior side of said hollow body that terminates near said screw;

g. A dustbin removably attached to said hollow body and below said screw; and h. A rotational driver-coupling mounted to the proximal end of the screw.

27. A canister for dispensing an article of a predetermined size and shape, comprising:

a. A screw, said screw having a distal and a proximal end;

b. A channel on the external surface of said screw, said channel being of a predetermined width and depth corresponding to the dimensions of said article;

c. A hollow body having a base surface, said body adapted to receive said screw mounted in a position substantially parallel to said base surface wherein:

i. the proximal end of said screw abuts a proximal wall of said body, and ii. a distal end of said screw abuts an aperture in a distal wall of said body;

d. A singulation ramp mounted within said body near the distal end of the screw;

e. A removable shelf mounted to an interior side of said canister;

f. A removable sidewall mounted to an interior side of said hollow body that terminates near said screw; and g. A rotational driver-coupling mounted to the proximal end of the screw.

28. A method for dispensing an article of a predetermined size and shape from a canister, comprising:

a. Activating a driver-coupling connected to a screw having a channel of a predetermined width and depth corresponding to the dimensions of said article;

b. Rotating said screw a predetermined number of degrees;

c. Removing an article from said channel, wherein such article first passed under a singulation ramp;

d. Repeating step (b) until detection of an article drop; and e. Stopping the rotation of said screw upon detection of an article drop.

29. The method of claim 28 further comprising:

a. Reversing the rotation of said screw a fraction of a turn.

30. The method of claim 29 for dispensing a plurality of articles, wherein said steps are repeated once for each article to be dispensed.

31. A method for dispensing an article of a predetermined size and shape from a canister, comprising:

a. Activating a driver-coupling connected to a screw having a channel of a predetermined width and depth corresponding to the dimensions of said article;

b. Rotating said screw until detection of an article drop;

c. Removing a second article from said channel, wherein such article first passed under a singulation ramp; and d. Stopping the rotation of said screw upon detection of an article drop.

32. The method of claim 31 further comprising:

a. Reversing the rotation of said screw a fraction of a turn.

33. The method of claim 32 for dispensing a plurality of articles, wherein said steps are repeated once for each article to be dispensed.

34. The method of claim 31 further comprising:

a. Stopping the rotation of said screw upon having a predetermined number of articles dispensed or detection of increased torque applied to said screw.

35. The method of claim 32 further comprising:

a. Reversing the rotation of said screw a fraction of a turn upon detection of increased torque applied to said screw; and b. Repeating the steps of claims 32 and 33 until a predetermined number of articles is dispensed or until detection of increased torque applied to said screw.

* * * * *